US011498814B1

(12) United States Patent
Joyce

(10) Patent No.: US 11,498,814 B1
(45) Date of Patent: Nov. 15, 2022

(54) CLAW DEVICE

(71) Applicant: Patrick Joyce, Chicago, IL (US)

(72) Inventor: Patrick Joyce, Chicago, IL (US)

( * ) Notice: Subject to any disclaimer, the term of this patent is extended or adjusted under 35 U.S.C. 154(b) by 0 days.

(21) Appl. No.: 17/742,511

(22) Filed: May 12, 2022

(51) Int. Cl.
*E02D 29/14* (2006.01)
*B66C 1/44* (2006.01)

(52) U.S. Cl.
CPC ..... *B66C 1/442* (2013.01); *E02D 29/1445* (2013.01)

(58) Field of Classification Search
CPC ..... B66C 1/422; B66C 1/44; B66C 1/442; B66C 3/04; B25J 17/02; B25J 15/0014; B25J 15/0028; B25J 15/0052; B65G 47/90; E02D 29/1445
See application file for complete search history.

(56) References Cited

U.S. PATENT DOCUMENTS 2,286,071 A * 6/1942 Dragan ..... B66C 1/422 294/119
5,755,476 A * 5/1998 Hosking ..... B66C 1/442 294/117
2012/0098285 A1 4/2012 Wall
2017/0158469 A1 6/2017 Schulte

FOREIGN PATENT DOCUMENTS

WO 2007028794 3/2007
WO 2016153367 9/2016

OTHER PUBLICATIONS

Joyce, Patrick, Declaration of Patrick Joyce, Jul. 8, 2022.

* cited by examiner

*Primary Examiner* — Lee A Holly
(74) *Attorney, Agent, or Firm* — Beem Patent Law Firm

(57) ABSTRACT

The present invention relates generally to a claw device for installing, removing, and repairing a manhole assembly. Claw device may include a base assembly and two or more arm assemblies. The arm assemblies may be configured to pivot in response to movement of a slide along an axis of a shaft extending upwardly from base assembly. In particular, when a lifting force is applied to the slide, one or more grip pads of arm assemblies may be configured to move inwardly toward the shaft and frictionally grip a surface of the manhole assembly. In one aspect, at least one arm assembly includes an extending member having a plurality of positions for adjusting the length of at least one arm assembly. Advantageously, claw device may be adjusted to accommodate for manhole assemblies of different diameters or other objects having various shapes and sizes.

18 Claims, 3 Drawing Sheets

CLAW DEVICE

FIELD OF INVENTION

The present invention relates generally to improved devices for lifting objects and, more specifically, to a claw device for installing, removing, and repairing a manhole assembly.

BACKGROUND OF THE INVENTION

Manhole assemblies, sometimes referred to as utility covers, are often installed on streets, highways, and other surface locations to provide access to underground areas for the installation, repair or inspection of, for example, electrical and/or telephone installations, storm drainage, sewers, and other utilities.

Manhole assemblies typically include a frame having a diameter of between about 24 inches and about 36 inches. The frame may extend, for example, from the surface of the ground downwardly to an underground area or interconnecting tunnel. Concrete or other known mixture may be backfilled about the frame to secure it in a desirable position. A removable lid may be placed over a top section of the frame for access.

Because manhole assemblies are predominantly made of iron and may weigh in excess of 200 pounds, the task of installing, removing, and repairing manhole assemblies can be challenging. In addition, traditional methods for accomplishing such tasks often require multiple steps. For example, an operator may need to first remove the lid for access to the frame and then grab or grip an internal surface of the frame. As a result, conventional machinery is not well adapted for such operations and often requires large amounts of resources, such as time, money, and manual labor.

Accordingly, there is a need for an improved device for engaging and lifting a manhole assembly during installation, removal, and repair. The present invention satisfies this need.

SUMMARY OF THE INVENTION

The present invention relates generally to devices for gripping objects and, more specifically, to a claw device for installing, removing, or repairing a manhole assembly. Claw device may include a base assembly and two or more arm assemblies. The arm assemblies may be configured to pivot in response to movement of a slide along an axis of a shaft extending upwardly from base assembly.

In one aspect, a clamp is releasably fastened to the slide via a pin. The pin may facilitate pivotal movement of clamp between a locked position and an unlocked position. More specifically, in locked position, a jaw of the clamp is lodged into a lip of the base assembly, thereby preventing movement of the slide. To release said clamp, an operator may apply pressure to a handle, which may withdraw the jaw from the lip and allow the slide to move freely along an axis of the shaft.

The slide may further couple with two or more arm assemblies. Each arm assembly may include a linking arm and an engaging arm. Linking arm may pivotally couple to the slide. Engagement arm may pivotally couple to the linking arm and a support leg of the base assembly. In such a configuration, each engagement arm may be configured to pivot relative to the shaft in response to movement of the slide along an axis of the shaft.

The slide may include a connector for coupling with, for example, a hook of a crane. Through use of the connector, a lifting force may be applied to the slide causing the arm assemblies to pivot inwardly toward the shaft. More specifically, engagement arms may be attached to grip pads that, in response to movement of the slide, are forced inwardly to engage a surface, such as a frame of the manhole assembly. When the grip pads are engaged with the frame, the manhole assembly may be lifted due to, for example, a friction force between the pads and the frame. When the manhole assembly is placed on a surface that can support its weight, the grip pads may disengage from the frame.

In addition to manhole assemblies, it is contemplated that claw device may be used on various objects. Specifically, at least support leg of said base assembly may include an extending member. The extending member may include a plurality of positions and be configured to secure to an attachment member. The attachment member may include slots for securing to at least one position on the extending member, thereby facilitating adjusting a length of said support leg to extend or shorten a distance between the base assembly and the gripping arm. In other words, at least one assembly arm of claw device may be adjusted to accommodate for manhole assemblies of different diameters or other objects having various shapes and sizes.

The present invention and its attributes and advantages will be further understood and appreciated with reference to the detailed description below of presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to limit the present invention, where like designations denote like elements, and in which.

DETAILED DESCRIPTION OF THE INVENTION

Figure 1:
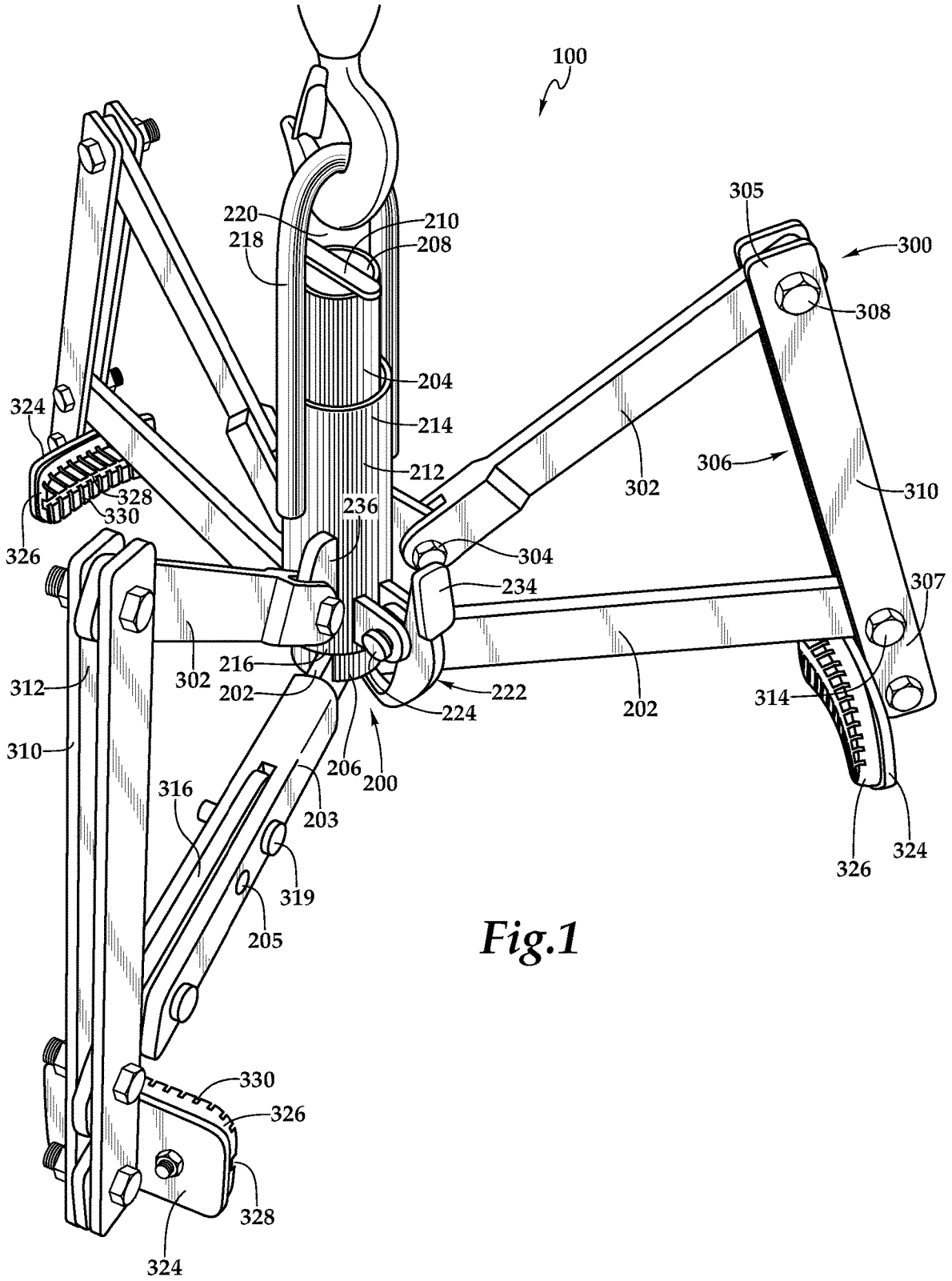
FIG. 1 is a perspective view of an exemplary claw device.

The present invention is generally directed to devices for gripping objects and, more specifically, to a claw device for installing, removing, and repairing a manhole assembly including a frame and a cover or lid. The figures illustrate different views of an exemplary claw device.

FIG. 1 through FIG. 5 illustrate an exemplary a claw device 100. Claw device may weigh between about thirty pounds and fifty pounds, and preferably between about forty pounds and about forty five pounds. As shown, claw device 100 may include a base assembly 200 and a plurality of arm assemblies 300.

Arm assemblies may include a linking arm 302 and an engaging arm 306 for engaging a manhole assembly 400, which may include a frame 402 and a cover 404. While manhole assembly 400 is shown to be substantially circular, other shapes are contemplated, such as rectangular, square, oval, D-shaped, triangular, and the like.

Components of claw device 100 may be made of steel or another metal sufficiently rigid to withstand heavy loads without bending. It is further contemplated that claw device 100 may be made of a corrosion resistance material, such as stainless steel, copper, bronze, or other alloys.

As shown in FIG. 1, base assembly 200 may include a plurality of support legs 202. Support legs 202 may extend outwardly a center of base assembly 200. While base assembly 200 is shown to include three support legs 202, any number of support legs are contemplated.

Support legs 202 may range in length from about ten inches to about twenty inches. In addition, a width of support legs 202 may be between about one inch and about three inches. Further, a thickness of support legs 202 may range from about a quarter inch to about half an inch. In one embodiment, support legs 202 may be approximately thirteen and a half inches long, approximately two inches wide, and approximately three eighths inches thick.

As shown in FIG. 1 and FIGS. 3-5, a shaft 204 may extend upwardly from base assembly 200. Shaft 204 may include a proximal end 206 and a distal end 208. Shaft 204 may range from about ten to about twenty inches in height, and preferably be about thirteen inches in height. In addition, a diameter of shaft 204 may range from about one inch to about three inches, and preferably be about two inches in diameter. While shaft 204 is shown to be cylindrical in shape, other shapes are contemplated.

Figure 2:
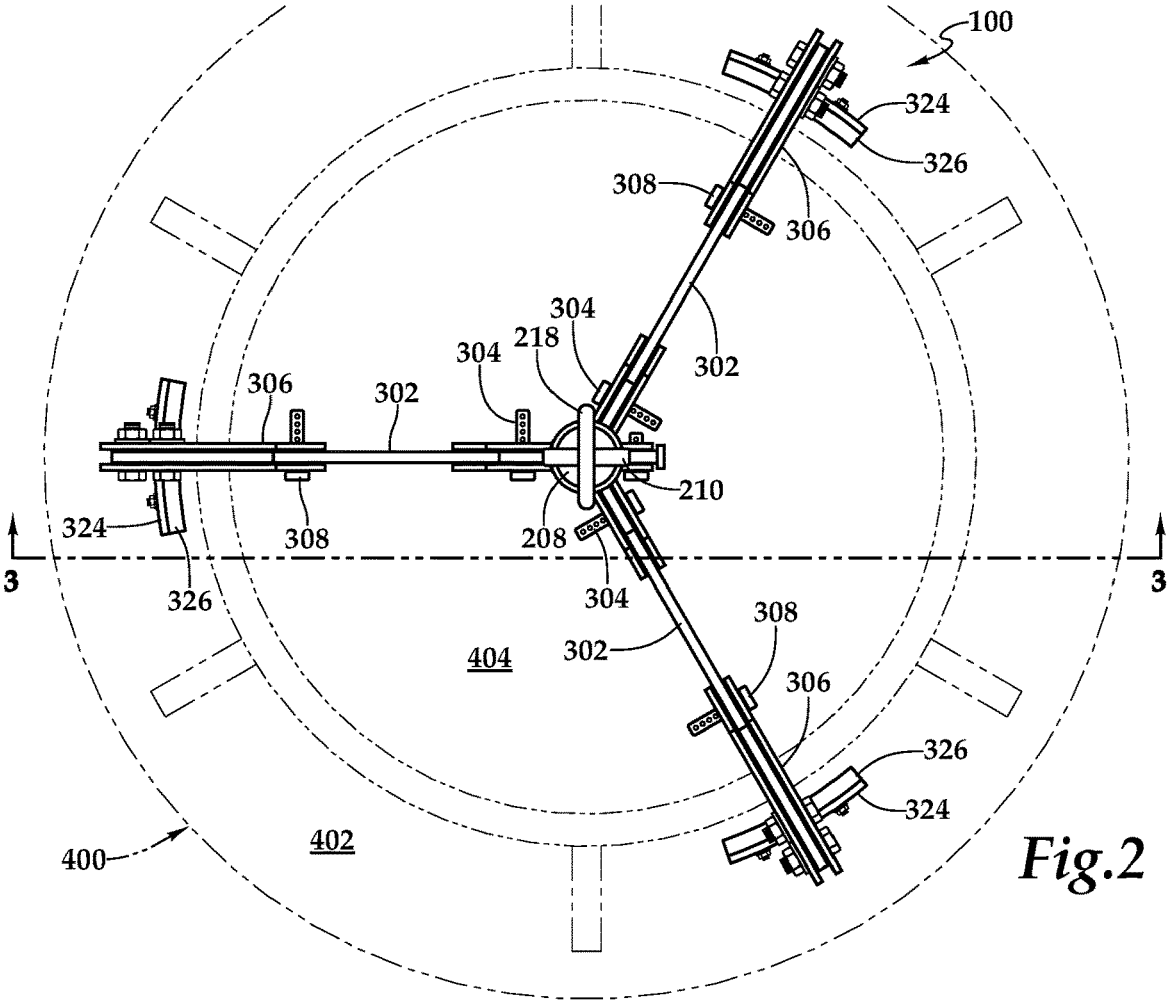
FIG. 2 is a top view of the claw device positioned above a manhole assembly.

As shown in FIG. 2, at distal end 208, shaft 204 may include a stopper 210. Stopper 210 may be a steel bar that is configured to, for example, limit a movement of a slide 212, as detailed below. At distal end 204, stopper 210 may extend between about one quarter of an inch and about one-half of an inch past the edges of shaft 204.

FIG. 1 and FIGS. 3-5 further illustrate the slide 212 of claw device 100. As shown, slide 212 is configured for movement about the axis of shaft 204 when a lifting force is applied to connector 218. Slide 212 may include an upper section 214 and a lower section 216. As shown, slide 212 may be a tubular shape having a diameter that is larger than the diameter of shaft 204 to facilitate movement about the axis of shaft 204. More specifically, a diameter of slide 212 may range from about two inches to about four inches. In one embodiment, the diameter of slide 212 is approximately two and five sixteenths inches. In addition, a height of slide 212 may range from about five inches to about ten inches, and preferably be about eight inches tall. Further, a thickness of slide 212 may be between about one sixteenth of an inch and about one quarter of an inch, and preferably be approximately one eighth of an inch thick.

As illustrated, upper section 214 of slide 212 may include a connector 218. Connector 218 may be secured to slide 212 via hardware, such as a bolt, or may be welded to an exterior surface of slide 212. As shown, connector 218 may be constructed to bend above proximal end 206 of shaft 204 to form an eyelet defining an opening 220. More specifically, depending on the position of slide 212, opening 220 may extend at least one inch above proximal end to, for example, couple with a hook of a crane, hoist, winch, trolley, and the like.

Figure 3:
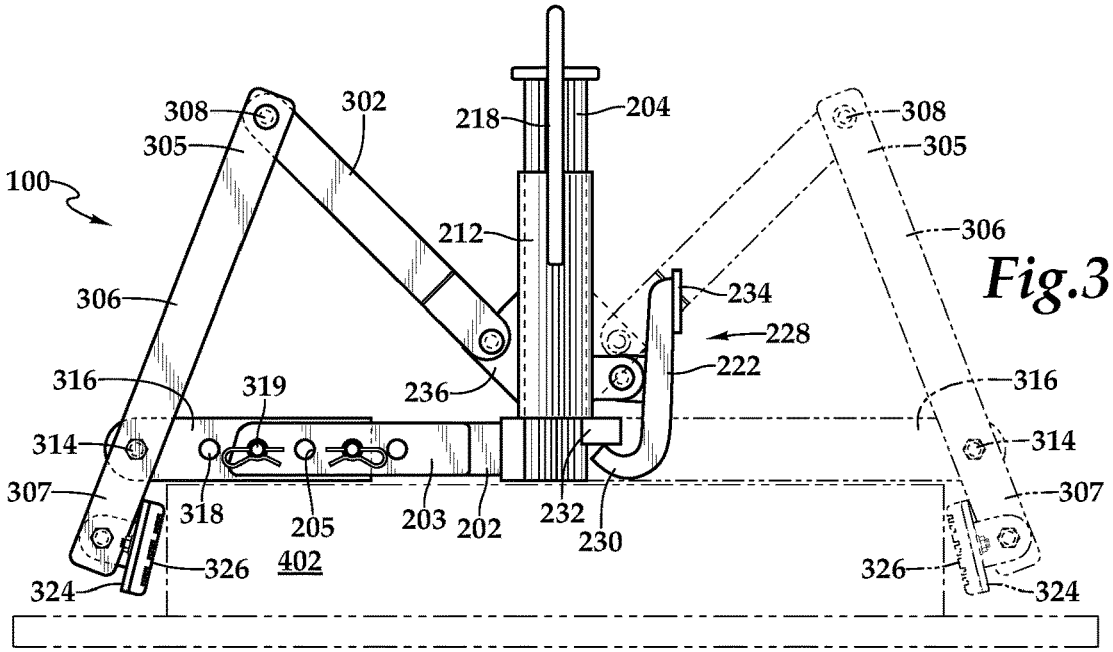
FIG. 3 is a side view of the claw device in a locked position.

At lower section 216, a clamp 222 of slide 212 may be releasably fastened to base assembly 200. Specifically, clamp 222 may be attached to slide 212 via a pin 224. For example, pin 224 may include one or more holes spaced (e.g., on-center spacing) apart approximately one quarter of an inch, each hole having a diameter of about one eighths of an inch. Pin 224 may facilitate pivotal movement of clamp 222 between a released position 226 (FIGS. 4, 5) and a locked position 228 (FIGS. 1, 3).

In released position 226, a jaw 230 of clamp 222 is configured to travel along the axis of shaft 204 until encountering a lip 232 of base assembly 200. Once there, jaw 230 of clamp 222 is adapted to lock or to drop into lip 232, thereby preventing movement of the slide 212 along an axis of shaft 204.

Figure 4:
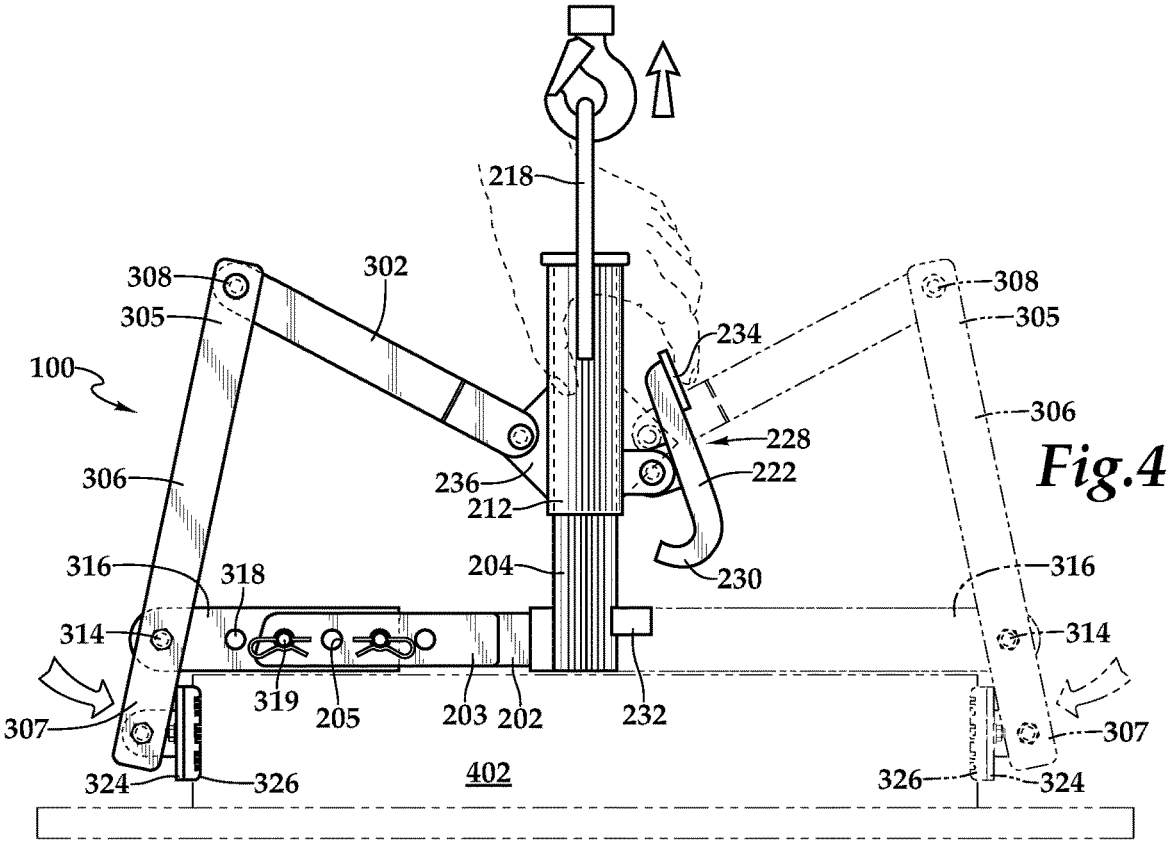
FIG. 4 is a side view of the claw device in an unlocked position and further including an engaging arm in an extended position for engaging with a frame of a manhole assembly.
Figure 5:
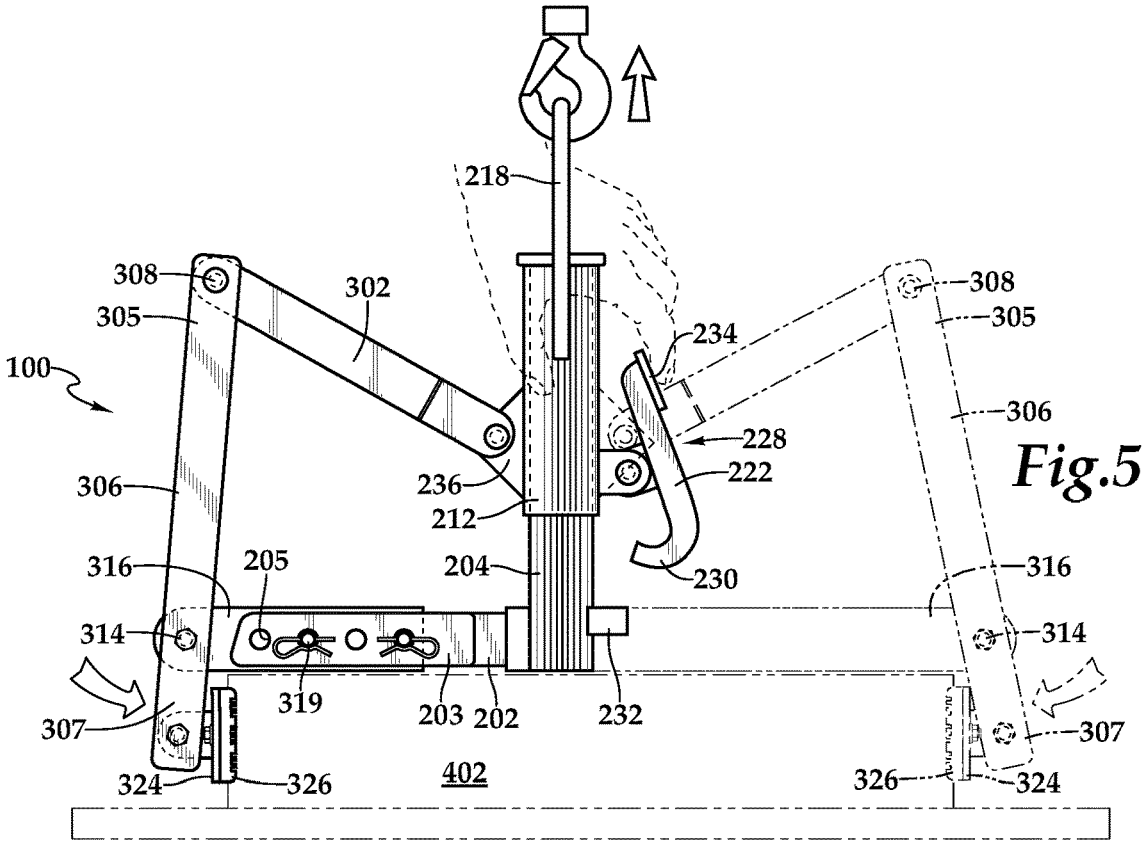
FIG. 5 is a side view of the claw device in an unlocked position and further including an engaging arm in a shortened position for engaging with a manhole frame having a smaller diameter than the manhole frame in FIG. 4.

As shown in FIGS. 4-5, in order to release clamp 222, an operator may apply an appropriate amount of pressure to a lever handle 234 causing clamp 222 to pivot, thereby withdrawing jaw 230 from lip 232. Once jaw 230 is withdrawn from lip 230, slide 212 may be lifted, such as via connector 218 as detailed above.

As further shown in FIG. 1 through FIG. 5, lower section 216 of slide 212 may include one or more ridges 236. Ridges 236 may be triangular in shape and extend outwardly from slide 212. In particular, ridges 236 may range from about two inches to about four inches in height, and preferably be about three inches in height.

In addition, ridges 236 may be aligned with and angled relative to support legs 202. Specifically, the angle between support legs 202 and ridges 236 may range between about thirty degrees and about sixty degrees, and preferably be about forty-five degrees.

Each ridge 236 of slide 212 may pivotably couple with one end of a linking arm 302 of arm assembly 300 via a pin 304. Similar to pin 224, pin 304 may include one or more holes spaced (e.g., on-center spacing) apart approximately one quarter of an inch, each hole having a diameter of about one eighths of an inch. In addition, pin 224 may be configured to provide for pivotal movement of linking arm 302 in response to movement of slide 212.

Linking arm 302 may range between about five inches and about fifteen inches in length. In addition, a width of linking arm 302 may be between about one inch and about three inches. Further, a thickness of linking arm 302 may range from about a quarter inch to about half an inch. In one embodiment, linking arm 302 may be approximately ten inches in length, approximately one and a half inches wide, and approximately three eighths inches thick.

As shown in FIGS. 3-5, one end of linking arm 302 is pivotally coupled to ridge 236 of slide 212 and, at the other end, linking arm 302 is pivotally coupled to a top section 305 of an engaging arm 306 via pivot pin 308. As such, linking arm 302 may pivotally interconnect slide 212 and engaging arm 306 to, for example, facilitate pivotal movement relative to each other and base assembly 200.

As shown in FIG. 1, engaging arm 306 may include two plates 310 such that linking arm 302 may fit between and pivotally connect to an interior surface 312 of plates 310 via pin 308. Each plate 310 may range between about ten inches and about twenty-five inches in length, and preferably between about fifteen inches and about twenty inches long. In addition, a width of engaging arm 306 may be between about one inch and about three inches. Further, a thickness of engaging arm 306 may range from about a quarter inch to about half an inch. In one embodiment, engaging arm 306 may be approximately ten inches in length, approximately one and a half inches wide, and approximately three eighths inches thick.

As illustrated, support leg 202 of base assembly 200 may be coupled to bottom section 307 of engaging arm 306. For instance, one or more support legs 202 may extend to fit between and connect to an interior surface 312 of plates 310 via hardware 314.

As shown in FIGS. 1, 3-5, one or more support legs 202 may be adjustable in length. Specifically, one or more support legs 202 may include an attachment member 203 and extending member 316. Attachment member 203 may be U-shaped and form an elongated insert that is configured to receive extending member 316. At one end, extending member 316 may be secured to plates 310 and extend from engaging arm 306 toward attachment member 203. It is also contemplated that attachment member 203 may be secured to plates 310 and extend from engaging arm toward extending member 316.

As shown in FIG. 4 and FIG. 5, extending member 316 may include a plurality of attachment points or positions 318. While extending member 316 is shown to include 3 attachment positions 318, any number of attachment positions are contemplated. Each attachment positions 318 may be between about one inch and about five inches apart. In one example, a first attachment position may be about one inch from a second attachment position and about three and three quarter inches from a third attachment position.

Attachment positions 318 may be configured for securing, via a fastener 319, to one or slots 205 in attachment member 203 for adjusting a length, thereby adjusting a distance between base assembly 200 and at least one arm assembly 300. Each attachment position may be configured to facilitate adjusting the length between about one inch and about five inches, and preferably between about two inches and about four inches. In one embodiment, each attachment point may correspond to adjusting the length of extending member 316 by about one inch.

For example, at least one engaging arm 306 may be adjusted inwardly and outwardly between an extended position 320 (FIG. 4) and a shortened position 322 (FIG. 5) such that claw device 100 is configured to accommodate manhole assemblies of different diameters. In one instance, engaging arm 306 may be adjusted outwardly to accommodate a manhole assembly used on highways. In another instance, engaging arm 306 may be adjusted inwardly to accommodate a lightweight suburban frame and lid, i.e., a manhole assembly used on streets.

Further, bottom section 307 of each engaging arm 306 may further be rotatably coupled to a guard 324. Guard 234 may connect with a grip pad 326. Grip pad 326 may be made from a rubberized material and attached via hardware, such as a bolt, and configured to pivot or rotate with respect to engaging arm 306. More specifically, grip pad 306 may range between about two inches and about ten inches in width, and preferably between about four inches and about six inches wide. In addition, a height of grip pad 326 may be between about one inch and about five inches, and preferably between about two inches and about four inches tall. Further, a thickness of grip pad 326 may range from about one eight of an inch to about half an inch. In one embodiment, grip pad 326 may be approximately five inches in width, approximately three inches tall, and approximately a quart of an inch thick.

As shown, grip pad 326 may be curved or arc-shaped and include a groove and a series of slits 330. Groove 328 and slits 330 may facilitate frictionally gripping a surface to which pad 328 is applied. For example, groove 328 may be central and extend along the length of grip pad 326. Further, grip pad 326 may include a series of slits 330. Slits 330 may extend from groove 328 to the bottom and/or top of grip pad 326 to form, for example, a series of trapezoidal shaped sections. Other groove and slit configurations are contemplated.

In operation, when a lifting force is applied to device 100 through use of connector 218, the grip pads 326 may to be forced inwardly until grip pads 326 are substantially flush against a surface of frame 402 of manhole assembly 400. When the grip pads 326 are engaged with a frame 402, manhole assembly 400 can be lifted. The weight of manhole assembly 400 may force the engaged pads 326 to grip onto frame 402 and the area of engagement may provide enough friction force to allow the lifting. When manhole assembly 400 is placed on a surface that supports its weight, for example, the friction force will be removed thus allowing the grip pads 326 to disengage from frame 402. It will be apparent to one skilled in the art that the operation of this claw device lends itself to multiple additional uses including but not limited to pallets of bricks, concrete slabs, frames of many kinds, tombstones, barrels, drums, and the like.

In sum, illustrated claw device 100 is intended for gripping and lifting an object, such as manhole assembly 400 for installing, removing, and repairing tasks. More specifically, when a lifting force is applied to slide 212, the pivoting motion of the linking arms 302 and engaging arms 306 causes the grip pads 326 to move toward the shaft 204, thereby gripping frame 402 of manhole assembly 400. This operation is illustrated in FIGS. 4-6, in which clamp 222 is in released position 226 and a lifting force is applied to slide 212 via connector 218 such that arm assemblies 300 are configured to pivot and cause pads 326 to engage with frame 402 of manhole assembly 400.

Conversely, when no lifting force is applied to slide 212, the engaging arms 302 and pads 326 may disengage from shaft 204, thereby releasing manhole assembly 400. For example, as illustrated in FIG. 3, when clamp 222 is in locked position 228, arm assemblies 300 are opened such that pads 326 spread past an edge of frame 402 and, thereby, do not grip manhole assembly 400.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described in the application are to be taken as examples of embodiments. Elements and materials may be substituted for those illustrated and described in the application, parts and processes may be reversed, and certain features of the invention may be utilized independently, all as would be apparent to one skilled in the art after having the benefit of this description of the invention. Changes may be made in the elements described in the application without departing from the spirit and scope of the invention as described in the following claims.

What is claimed is:

1. A claw device for use in lifting a manhole assembly, comprising:

a base assembly;

a shaft extending upwardly from said base assembly;

a slide movable along the shaft, said slide including an upper section and a lower section;

a clamp configured to releasably secure said slide to said base assembly;

two or more arm assemblies, each arm assembly comprising:

a linking arm pivotally coupled to said slide; and an engaging arm pivotally coupled to said linking arm and said base assembly, wherein said engagement arm is configured to pivot relative to said shaft in response to movement of said slide along said shaft.

2. The claw device of claim 1, wherein said slide further includes a connector extending above the shaft.

3. The claw device of claim 2, wherein said connector is an eyelet defining an opening of between about 1 inch and about 3 inches in height.

4. The claw device of claim 1, wherein said engaging arm is rotatably coupled to a pad for engaging a surface of a manhole assembly.

5. The claw device of claim 4, wherein said pad is curved and includes one or more grooves.

6. The claw device of claim 1, wherein said base assembly including one or more support legs, wherein at least one support leg includes an attachment member and an extending member.

7. The claw device of claim 6, wherein said extending member including a plurality of positions corresponding to one or more slots on said attachment member, wherein said plurality of positions facilitate adjusting a distance between the base assembly and said engaging arm.

8. The claw device of claim 1, wherein said shaft includes a stopper for limiting said movement of the slide.

9. The claw device of claim 1, wherein said linking arm is connected to a ridge of said slide via a pin.

10. The claw device of claim 1, wherein said engaging arm comprises two plates such that said linking arm fits between and is pivotally coupled to an interior surface of said plates.

11. The claw device of claim 1, whereby a lifting force on said slide causes said engaging arm to move toward said shaft for frictionally gripping a frame of the manhole assembly, which is released when said lifting force is removed.

12. The claw device of claim 1, wherein said linking arm is between about five inches and about fifteen inches in length.

13. The claw device of claim 1, wherein said engaging arm is between about fifteen inches and about twenty inches in length.

14. The claw device of claim 1, wherein an angle formed between said base assembly and said linking arm is between about thirty degrees and about sixty degrees.

15. The claw device of claim 1, wherein a height of said shaft is between about ten inches and about twenty inches.

16. The claw device of claim 1, wherein a diameter of said shaft is between about one inch and about three inches.

17. The claw device of claim 1, wherein a height of said slide is between about five inches and about ten inches.

18. The claw device of claim 1, wherein a diameter of said slide is larger than a diameter of said shaft.

* * * * *